US005819854A

United States Patent [19]

Doane et al.

[11] Patent Number: 5,819,854

[45] Date of Patent: Oct. 13, 1998

[54] ACTIVATION OF DOWNHOLE TOOLS

[75] Inventors: James C. Doane, Friendswood; William David Henderson, League City; Henry Joe Jordan, Jr., Conroe, all of Tex.

[73] Assignee: Baker Hughes Incorporated, Houston, Tex.

[21] Appl. No.: 595,884

[22] Filed: Feb. 6, 1996

[51] Int. Cl.[6] ..... E21B 34/06

[52] U.S. Cl. ..... 166/373; 166/66.4; 166/66.7; 166/319

[58] Field of Search ..... 166/53, 64, 65.1, 166/66.4, 66.6, 66.7, 319, 373

[56] References Cited

U.S. PATENT DOCUMENTS

| | | | |
|---|---|---|---|
| 5,234,057 | 8/1993 | Schultz et al. | 166/64 X |
| 5,279,363 | 1/1994 | Schultz et al. | 166/64 X |
| 5,332,035 | 7/1994 | Schultz et al. | 166/64 X |
| 5,375,658 | 12/1994 | Schultz et al. | 166/64 X |

*Primary Examiner*—Roger J. Schoeppel
*Attorney, Agent, or Firm*—Fishman, Dionne, Cantor & Colburn

[57] ABSTRACT

A primarily electronically set permanent or retrievable downhole tool having a hydraulic contingency arrangement to activate the downhole tool in the conventional way in the event electronic communication fails.

36 Claims, 9 Drawing Sheets

TO FIG. 2
TO FIG. 3
TO FIG. 4
FROM FIG. 1
FROM FIG. 2
FROM FIG. 3

TO FIG. 8
TO FIG. 9
TO FIG. 10
FROM FIG. 7
FROM FIG. 8
FROM FIG. 9

TO FIG. 12
TO FIG. 13
TO FIG. 14
FROM FIG. 11
FROM FIG. 12
FROM FIG. 13
38
40
28
22
20
88
80
90
82
78
76
74
62
46
66
68
50
42
118
116
96
104
102
106
110
100
120
98

TO FIG. 20

FROM FIG. 19
TO FIG. 21

FROM FIG. 20
TO FIG. 22

FROM FIG. 21

FROM FIG. 23
TO FIG. 25

FROM FIG. 24
TO FIG. 26

FROM FIG. 25

TO FIG. 28

FROM FIG. 27
TO FIG. 29

FROM FIG. 28
TO FIG. 30

FROM FIG. 29

ACTIVATION OF DOWNHOLE TOOLS

BACKGROUND OF THE INVENTION

1. Field of the Invention

This invention relates to the activation of downhole tools. More particularly, this invention relates to permanent or retrievable downhole tools activated primarily via electronic means and contingently by hydraulic means.

2. Prior Art

Most commonly, the prior art method of activating downhole tools has been to run a blanking plug on wireline unless the desired location for the plug is a very long way from the surface or the well presents other commonly difficult situations. Under the more difficult circumstances coil tubing is employed whether by wireline or coil tubing the plug is run to below the tool and pressure is raised from the surface to deploy the tool hydraulically. The method is reliable, however, the costs of running a wireline or coil tubing string are easily in the six figure cost area. Therefore, it has been desirable to find new ways to activate downhole tools. Some methods include electronic arrangements of all types which can save significant amounts of money by avoiding the coil tubing run and, moreover, by more quickly setting the desired tool so that work on the next step of the well can ensue more quickly. A drawback to the electronic set tools, however, is that if the tool fails substantially more money must be spent and a significant amount of time is lost. This is because the defective tool must be brought back to the surface and either replaced or repaired and then retripped into the hole to try again. Alternatively, a conventional tool may be used instead. Either way time and money are lost.

SUMMARY OF THE INVENTION

The above-discussed and other drawbacks and deficiencies of the prior art are overcome or alleviated by the electronic/hydraulic actuating arrangement of the invention.

The invention comprises an arrangement whereby a downhole tool is actuated primarily by electronic means and contingently by hydraulic means. The primary electrical method uses an electrical or mechanical stimulus to activate another electrical device. One preferred embodiment employs a sensor (e.g., a strain gauge) to sense a preprogrammed number of signals or strain pulses which then triggers the electronic circuitry to allow current from the batteries to flow through a resistor (preferably nickel chromium wire) positioned such that a Kevlar wrap, which prevents activation of the tool, will be defeated thus allowing the deployment sequence to begin. As one of skill in the art will readily recognize, many other arrangements depending on electric actuation are equally feasible since the primary consideration is to provide an opening in a wall of the atmospheric chamber to allow flooding thereof, thereby activating the tool. Some alternatives, by no means exhaustive, include a solenoid valve, an explosive charge which may advantageously be in the from of a bolt, a laser, a drill, a screw gun type device in combination with a threaded machine bolt, electronic punch tool, etc. Hydraulic pressure from the surface is not necessary due to atmospheric chambers in the tool which facilitate desired movement. In the event the electronic activation fails however, hydraulic pressure is employable to activate the downhole tool.

In the case of a successful electronic deployment or activation, predetermined events having been sensed by appropriate electronics, a signal is transmitted to a battery pack carried near the downhole tool which then flows current to a heating element or resistor wire. The heating element is employed to thermally sever a Kevlar cord which until severed maintains static positioning of the parts of the tool. Kevlar possesses a very high tensile strength but extremely low heat resistance and is, therefore, ideal for use in the invention.

Once the Kevlar is severed a series of mechanical components move, initially from the potential of a spring which is released, allowing specific atmospheric chambers within the tool actuation area to flood with the surrounding fluid. Upon flooding of the chambers, pistons move and the tool is activated.

In the event an electrical failure occurs, the invention provides for a deployment or activation by conventional means utilizing a coil tubing or a wireline to run a plug below the tool and use hydraulic pressure to actuate the tool. This avoids the need to trip the tool out of the hole for repairs thus saving hundreds of thousands of dollars not to mention up to several days of lost time.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE PREFERRED EMBODIMENTS

For purposes of the ensuing discussion a Packer will be the downhole tool illustrated and described. It will be appreciated, however, that the electronic actuation mechanism and hydraulic contingency of the invention are employable with any downhole tool.

Figures 1, 2, 3, 4:
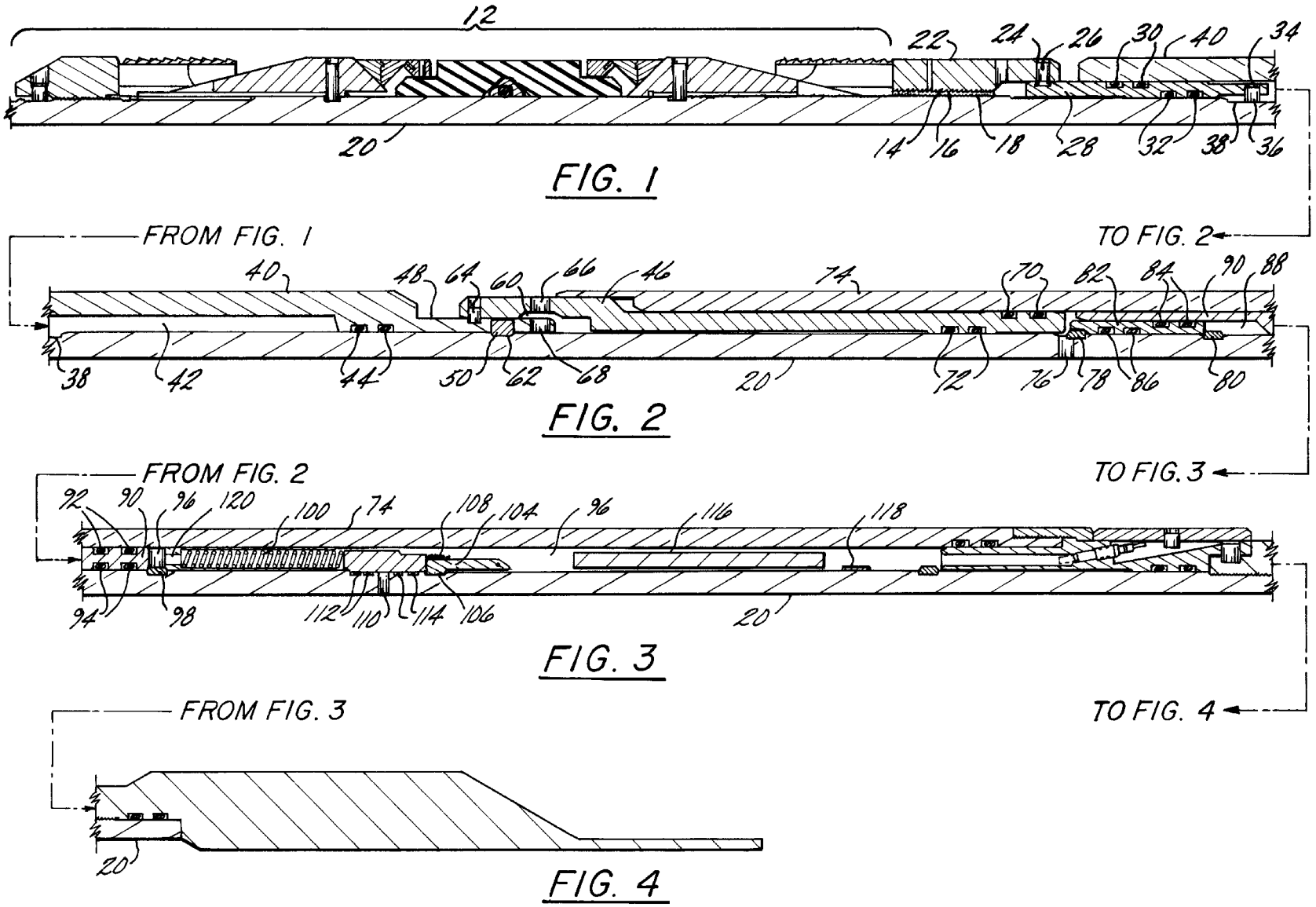
FIGS. 1–4 are an extended longitudinal cross-section view of a first embodiment of the invention with the tool in the run in position.
Figure 5A:
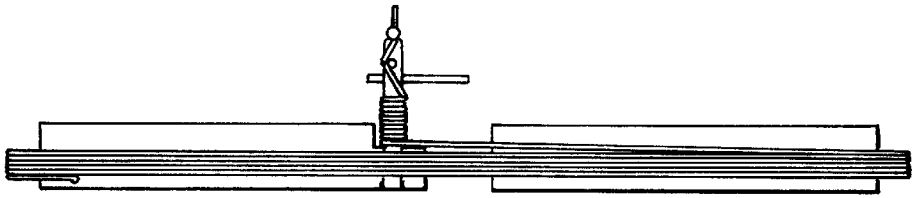
FIG. 5A is an elevational view of the Kevlar wound segments of the invention removed from surrounding elements.
Figure 5B:
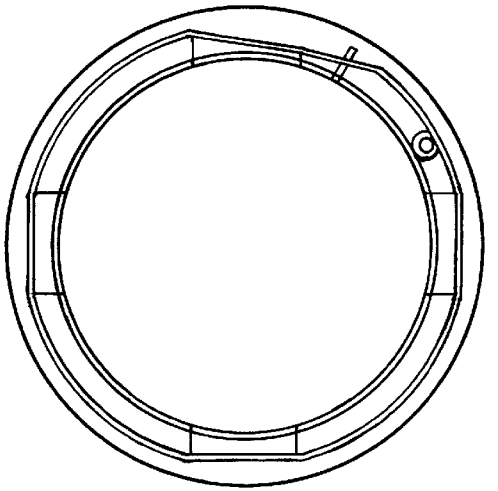
FIG. 5B is a plan view of the Kevlar wound segments of the invention removed from surrounding elements before the Kevlar is severed.
Figure 5C:
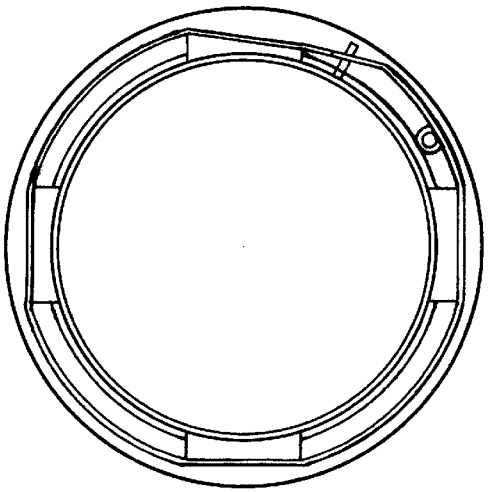
FIG. 5C is a plan view of the Kevlar wound segments of the invention removed from surrounding elements after the Kevlar has been severed.

Referring to FIG. 1 the uphole end of the arrangement is illustrated. One skilled in the art will recognize the SB-3 Packer assembly manufactured by Baker Oil Tools and commercially available through the same. A detailed description of the packer 12 is not necessary here since Baker Oil Tools model S and model D packers have been known to the industry for approximately thirty years. Threaded arrangement 14 provides for axial adjustment of the various components which is necessary on tools of extended lengths. Arrangement 14 also includes ratchet surface 16 on the inside surface thereof for communication with reverse ratchet surface 18 on the outside of production tubing 20. Lower slip ring 22, upon which threaded arrangement 14 is cut, further includes bore 24 for shear pin 26. The pin 26 extends between ring 22, which is axially moveable and fixed piston 28 which, as its name suggests, does not move. No load is applied to the pin 26, however, until a dog 50 located downhole thereof is released by actuation of the mechanism.

Fixed piston 28 includes four o-rings 30 and 32, two (30) on the exterior surface and two (32) on the interior surface and further includes a set screw passage 34 for screw 36 which extends into groove 38. Set screw 36 is employed to maintain fixed piston 28 in place after proper adjustment of threaded arrangement 14 on ring 22.

Extending from FIG. 1 and into FIG. 2 is setting piston 40. The upper extremity of setting piston 40 extends annularly outwardly from fixed piston 28 and assists in defining an atmospheric chamber 42. Fixed piston 28 defines the upper end of chamber 42 and production tubing 20 provides the inner wall. As one skilled in the art will readily recognize, the particular shape of setting piston 40 does not require another member to seal the lower extremity of chamber 42. Effecting the seal are o-rings 30 and 32 as well as o-rings 44. The significance of the chamber is discussed hereinafter. Setting piston 40, moving along the illustration in the downhole direction, becomes thinner in annular dimension and extends under support sleeve 46. This is slide dog section 48. Slidingly operating with slide dog section 48 is dog 50 which locks all uphole components in place until it is released by movement of support sleeve 46. Sleeve 46 provides dog receiver 60 to allow dog 50 to move outwardly and disengage from dog groove 62. Sheer pin 64 is also provided which extends between dog section 48 and sleeve 46 to prevent relative movement of setting piston 40 and support sleeve 46. As is also apparent, assembly ports 66 and 68 are provided to allow insertion of a rod during assembly of the device to prevent unintended shearing of the pins. Support sleeve 46 extends downhole and supports two sets of o-rings 70 and 72. Rings 70 ride and seal on edge housing 74; rings 72 ride and seal on production tube 20.

At the downhole extreme of support sleeve 46, a pressure port 76 is illustrated extending through tubing 20. This port is part of the contingency hydraulic operation of the tool. It is important to note that an alternate and perhaps commercially preferred embodiment of the invention omits the port 76 in favor of a production tube with no breaches. In the event that such embodiment is employed, a punching tool would be necessary to operate the system hydraulically. Even though more is required to operate the tool hydraulically, the incidence of electronic failure is small enough to render the perceived benefit of non breached tubing a preferable arrangement.

Immediately, adjacent port 76 is c-ring 78 which in combination with c-ring 80 prevents movement of second fixed piston 82. Piston 82 has outer o-rings 84 and inner o-rings 86. The o-rings 84 and 86 maintain a seal between the ambient hydrostatic pressure and the second atmospheric chamber 88.

Annularly outside of second fixed piston 82 is the upward extent of piston 90. The downhole extent of piston 90 includes o-rings 92 and o-rings 94. These sets of o-rings maintain the seal for third atmospheric chamber 96. Preventing piston 90 from moving downhole into atmospheric chamber 96 is c-ring 98. C-ring 98 further acts to provide the uphole stop for spring assembly 100. The spring assembly comprises preferably 24 springs whose axes are parallel to the axis of the string and are arranged annularly therearound. The springs 100 are maintained in a compressed condition by spring holder 102 in combination with dog assembly 104 which anchors said spring holder by protruding into slot 106. Dog assembly 104 is kept in slot 106 by a Kevlar wrap 108. At rest the dog assembly 104 would grow radially and disengage from slot 106. Aside from controlling springs 100, the holder 102 also prevents the influx of hydraulic fluid through port 110 by physically obscuring the port and by preventing leakage by contacting two pairs of o-rings 112 and 114 on the tubing 20.

Inside atmospheric chamber 96 is also the power source and electronics 116 and a sensor 118 which are protected from hydraulic fluid until the tool is actuated. The chamber 96 is bounded on the downhole end by conventional elements including connector for a diagnostic or programming computer. Suitable o-rings are placed to seal the chamber.

Referring now to FIGS. 1–14 inclusive, various stages of operation of the tool are illustrated.

Electronic operation of the tool comprises the sensing of a predetermined event or number of events by sensor 118 which is preferably a strain gauge. The sensor sends a signal each time an event is detected, with the electronics evaluating the signals and determining when to activate. When the system has sensed the appropriate signals, current from the power source (generally batteries) is flowed to a resistor wire (not shown) which is in contact with at least one of the winds of Kevlar wrap 108. As the resistor wire increases in temperature the Kevlar, which possesses a high tensile strength but a very low melting point, melts thus allowing dogs 104 to disengage from slot 106. Once the dogs have disengaged the force stored in compressed spring assembly 100 moves spring holder 102 downhole and off of port 110 thus flooding atmospheric chamber 96 with hydraulic fluid. The fluid moves through port 120 and into another section of chamber 96 whereafter the increasing pressure begins to urge edge piston 90 uphole. Edge piston 90 moves uphole, contacting a downhole end of support sleeve 46 and transmits the force thereof into sleeve 46. As sleeve 46 is urged uphole the shear pin 64 shears and allows the sleeve 46 to move relative to setting piston 40. As one will appreciate, dog receiver 60 is thereby positioned over dog 50 allowing the same to disengage from slot 62. Upon continued urging of sleeve 46 uphole it abuts setting piston 40 and urges setting piston 40 uphole. As will be appreciated, all of the movements herein are assisted by the existence of atmospheric chamber 42 because of the relative vacuum it provides.

As setting piston 40 impacts lower slip ring 22, pine 26 shears and ring 22 moves uphole deploying packer assembly 12. It will be appreciated that the packer assembly illustrated is a SB-3 Packer commercially available from Baker Oil Tools, Houston, Texas.

In the event that the electronic means for deploying the packer (or other tool) fails, a plug (not shown) can be run on coil tubing or a wireline and the device could be activated hydraulically.

Referring to FIGS. 15–18, the distinctions in movements of the various discussed elements are apparent to those of skill in the art. It must be appreciated that if the embodiment mentioned above which initially lacks port 76 is employed, a punching tool must first be run to create the port in the production tubing 20. Once the port 76 exists either by being relocated or by being punched, pressure applied from the surface is forced through port 76 and actuates all of the elements above the port in the same manner as they were actuated electronically. All elements below port 76 are not moved in the hydraulic contingency actuation.

As will be appreciated by one of skill in the art, the electronic actuation means is significantly less expensive and easier to use than the prior art method of running a plug on coil tubing, however, even in the unlikely event of failure of the electronic means, deployment of the downhole tool can be completed by using the prior art coil tubing method since the invention provides for such contingency deployment. Therefore, no additional expenditure of tripping the tool out of the well is necessary for the benefit of a better electronic mechanism.

In an alternate embodiment of the electronic/contingency hydraulic tool actuation invention a retrievable packer is set using the principles of electronic primary means and hydraulic backup means and is retrieved by utilizing a retrieving tool to begin a mechanical train of events which allow the components of the tool to lengthen, collapsing the packer and allowing withdrawal of the tool.

Referring to FIGS. 19–22, the removable packer arrangement is illustrated in the run-in position. As in the embodiment discussed above, the primary deployment mechanism is electronics coupled to mechanical elements. Beginning from the uphole end of the tool a mandrel 210 extends almost the complete length of the tool. Mounted on mandrel 210 in sliding, shear screw or fixed arrangement are upper drift ring 212 having set screw 214. Drift ring 212 is threaded onto mandrel 210 and is known to the art. Moving downhole is a standard HP/HT packer arrangement 216 which is commercially available from Baker Oil Tools, Houston, Texas. Because the arrangement of the packer 216 is known, a detailed description of all of the parts thereof is not required. There are, however, two elements of the invention located underneath (in the drawings hereof) (i.e., near the id) the packer which are extremely important to the retrievability of the invention; these are slip saver ring 220 and slip saver pickup ring 222. These rings provide the critical sequence (along with mandrel 210) to "unlock" the packer allowing it to lengthen, facilitating removal from the hole.

Figures 19, 20, 21, 22:
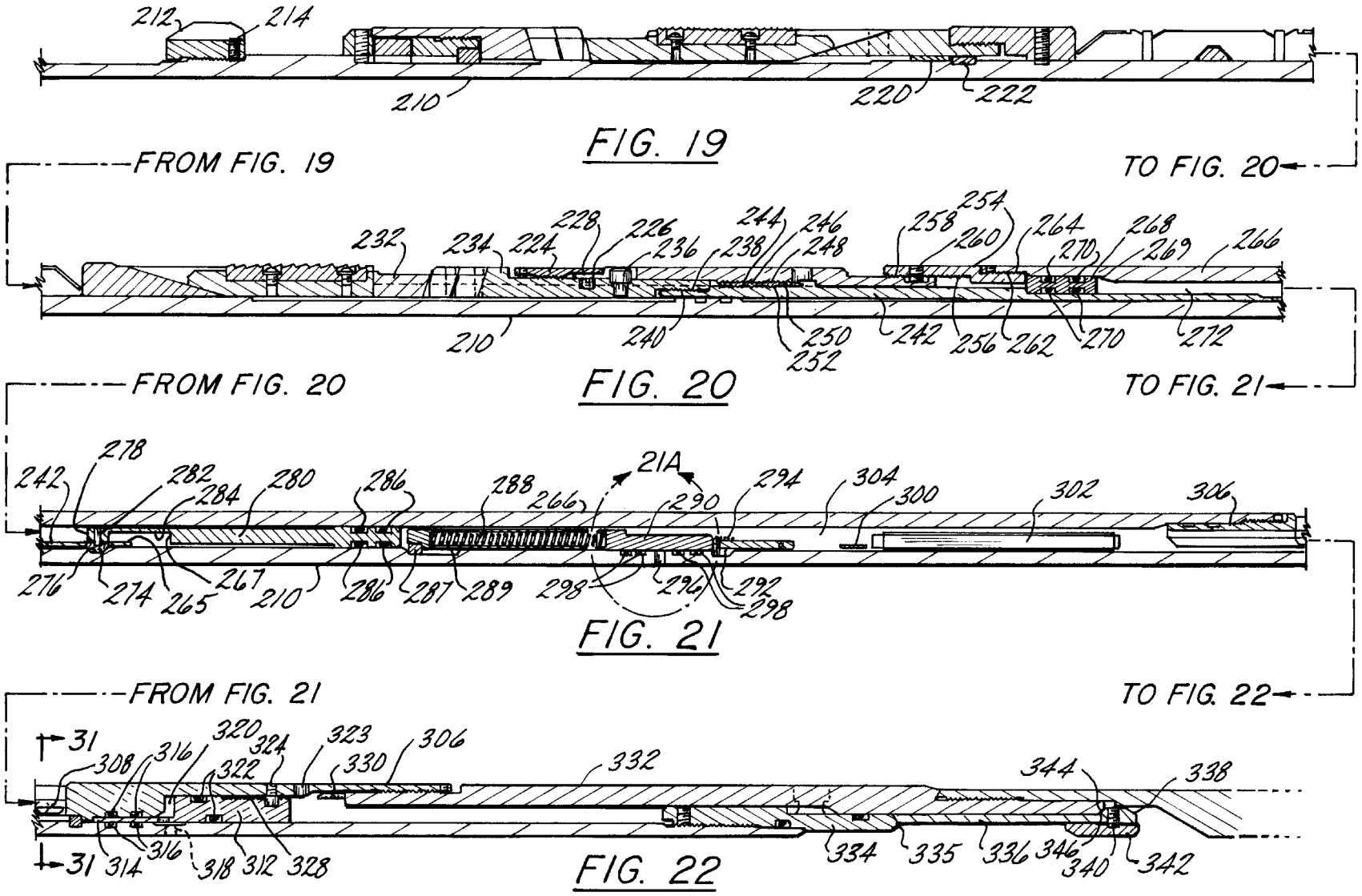
FIGS. 19–22 are an extended longitudinal cross-section view of a second embodiment of the invention with the tool in the run in position.

Downhole of the insert and lower slip of the packer element referring to FIG. 20 are several elements which are known to the art but which communicate with elements of the invention. These are adjustment nut 224 which retains slip lock segment 226 preventing it from falling downhole, after it is released by nose 228 of body lock ring retainer 230 (the body lock ring retainer is a novel element). Nose 228 of retainer 230 when in run in and initial deployment maintains segment 226 in contact with the slip lock 232 to bias that portion first. Subsequently, the segment 226 is allowed to move outwardly disengaging from slip lock 232 and allowing the transmission of force from downhole elements to go directly into the lower slip ring 234. Segment 226 is retained in its initial position through about 1.5 inches of movement before being released. This length is determined by how much of nose 228 extends over segment 226.

Continuing downhole, set screw 236 is old in the art and prevents rotational movement of the assembly. Set screw 236 extends through body lock ring retainer and into lower slip ring 234. Lower slip ring 234 includes box thread 238 to mate with pin thread 240 on body lock ring sleeve 242. Between body lock ring retainer 230 and body lock ring sleeve 242 is body lock ring 244 which includes both ID and OD threads. Body lock ring OD threads 246 are of a wide cut to mate with wide cut threads 248 on the ID of retainer 230 and are not intended to move longitudinally relative to threads 248 but rather are to allow play so that body lock ring ID threads 250 can ratchet up the body locking sleeve OD threads 252. As will be appreciated, ratcheting requires that the elements expand and contract to ratchet over one another. It should be noted that the threads 252 on body locking sleeve 242 are unidirectional to prevent lock ring 244 from moving the other way.

Adjustment sleeve 254 includes box thread 256 which is movable with body lock ring retainer pin thread 258. A set screw 260 is installed after adjustment is completed. Adjustment sleeve 254 also includes a pin thread 262 which mates with box thread 264 on piston housing 266. A set screw 268 is also provided to lock this part after adjustment. Between the piston housing 266 and body lock ring sleeve 242 is disposed upper piston 268. Piston 268 provides o-rings 270 to effectively seal in an atmospheric chamber 272.

Referring to FIG. 21 a dog 274 is maintained in a notch 276 in mandrel 210 by hook 278 of lower piston 280. A shear pin 282 is also provided through hook 278 and into dog 274. Lower piston 280 is provided with undercut 284 adjacent hook 278 to receive dog 274 when the tool is actuated,. Release of dog 274 from notch 276 allows piston 280 to push body lock ring sleeve 242 in the uphole direction.

Lower piston 280 includes four o-rings 286, two on each of the OD and the ID of the piston.

Figure 21A:
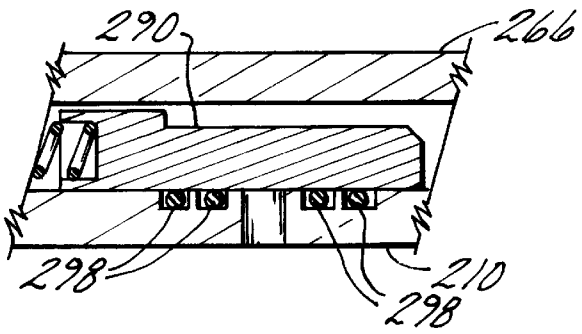
FIGS. 21A and 21B are enlarged views of the embodiments of the circumscribed section of FIG. 21.
Figure 21B:
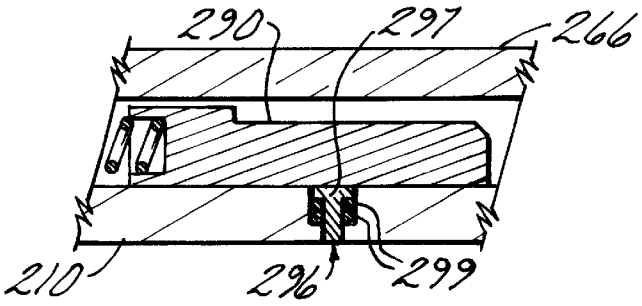
Figures 23, 24, 25, 26:
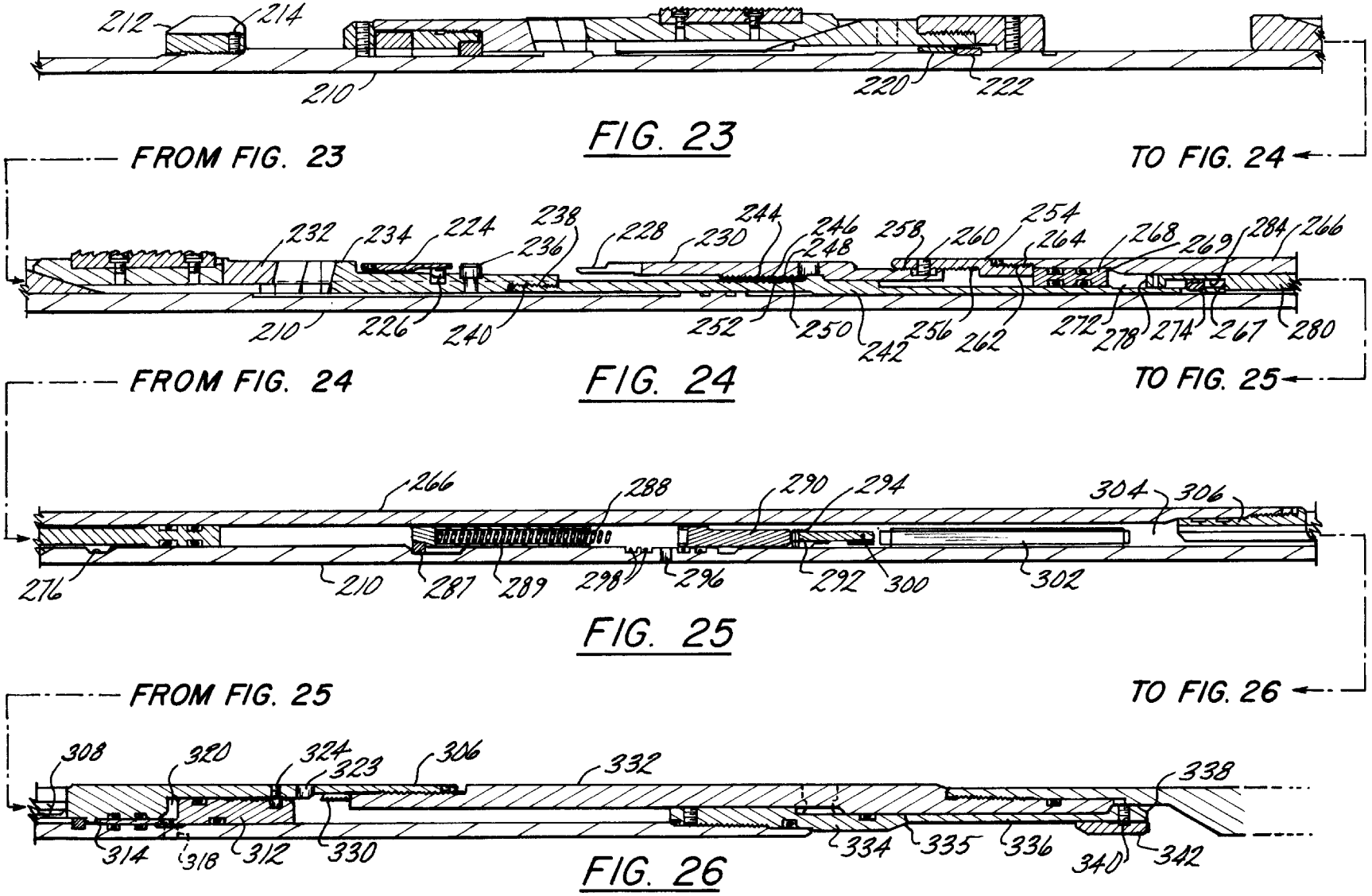
FIGS. 23–26 are an extended longitudinal cross-section view of the embodiment of FIGS. 19–22 with the electronic actuation mechanism activated.
Figures 27, 28, 29, 30:
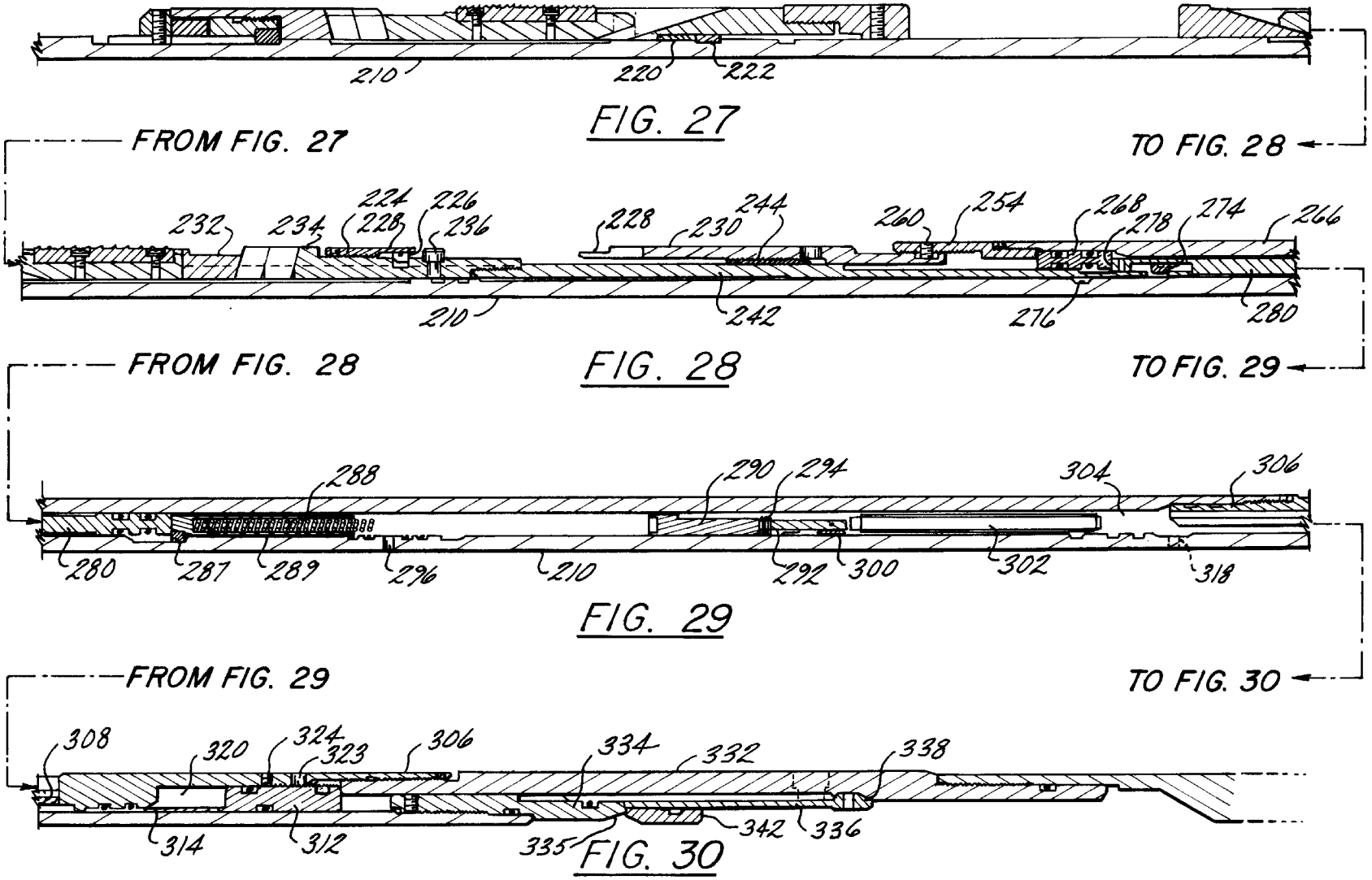
FIGS. 27–30 is an extended longitudinal view of the tool of the second embodiment in the release/retrieval position.

Continuing downhole still referring to FIG. 21, spring assembly 288 is disposed between piston housing 266 and mandrel 210. 24 springs are preferably employed and oriented annularly and extending in parallel with the axis of the tool as they were in the prior embodiment. The spring is maintained in the compressed piston as was the spring assembly in the previously described embodiment. Spring piston 290 is connected to a dog assembly 292 which is maintained in a locked position in the mandrel 210 by a wrapped preferably Kevlar cord 294. Also, as in the previous embodiment, the spring piston 290 seals a port 296 by being positioned thereover and sealed. The sealing may be accomplished by o-rings 298, as illustrated in FIG. 21 and 21A which is an enlarged view of circumscribed area 21A—21A, but preferably is by a plug 297 disposed in the port 296 itself as illustrated in FIG. 21B which is an extracted view of the this section of the tool illustrating the plug embodiment. The plug 297 is sealed by o-rings 299. Due to large frictional forces placed on spring piston 290 by o-rings 298 in the 21A embodiment, and the comparatively large springs needed to overcome the force, the embodiment of FIG. 21B is preferred. The plug embodiment provides a reliable seal with very little friction on the spring piston 290 enabling the use of smaller lighter and less expensive springs.

The spring assembly 288, spring piston 290, dog assembly 292, strain gauge 300 and electronics 302 are all housed in an atmospheric chamber 304, the flooding of which causes the tool to deploy.

Figure 31:
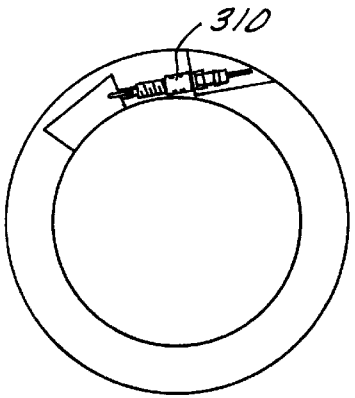
FIG. 31 is a cross-section of the tool taken along line 31—31 illustrating the diagnostic computer port.
Figures 7, 8, 9, 10:
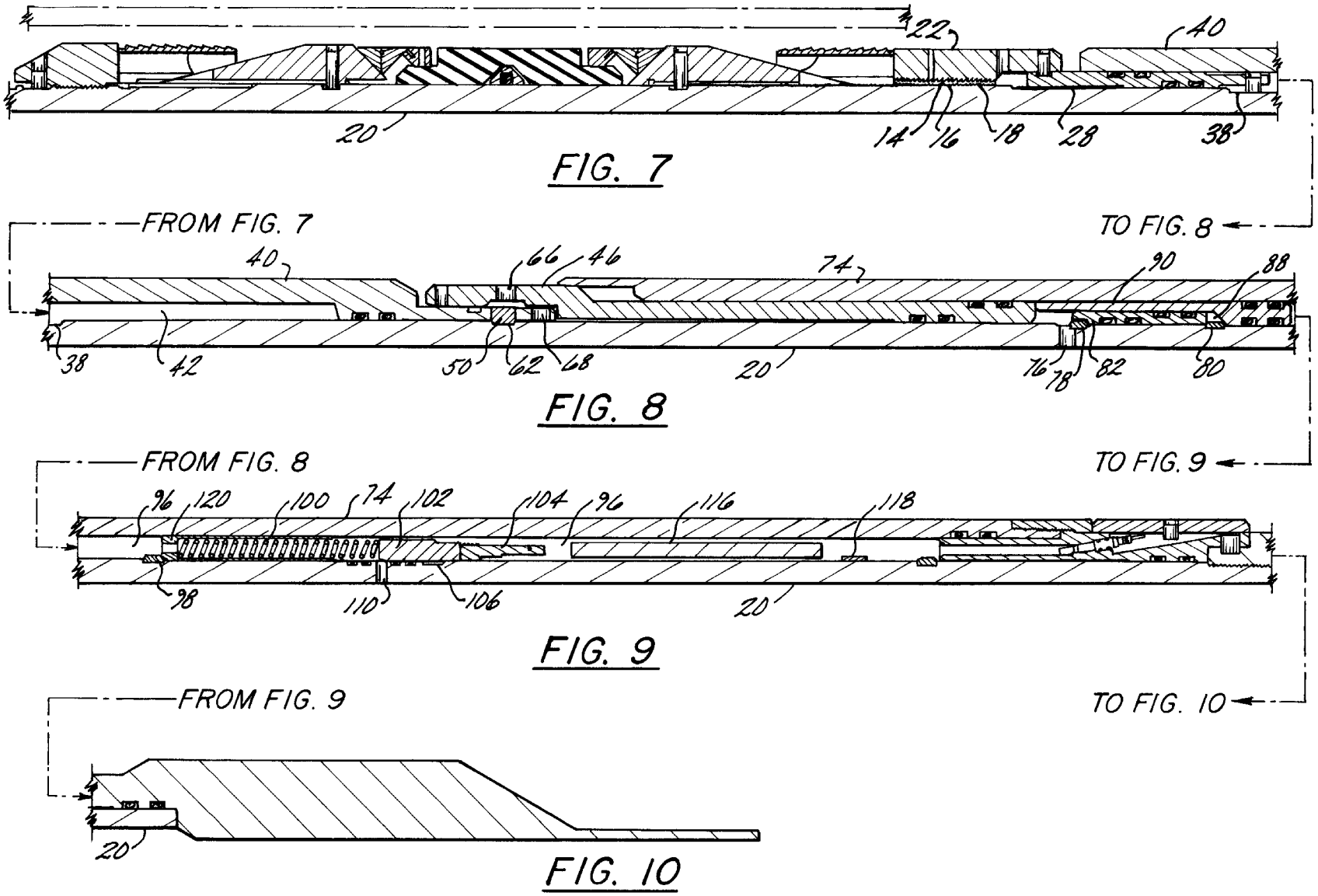
FIGS. 7–10 are an extended longitudinal cross-section view of the embodiment of FIGS. 1–4 with the electronic actuation mechanism activated.
Figures 11, 12, 13, 14:
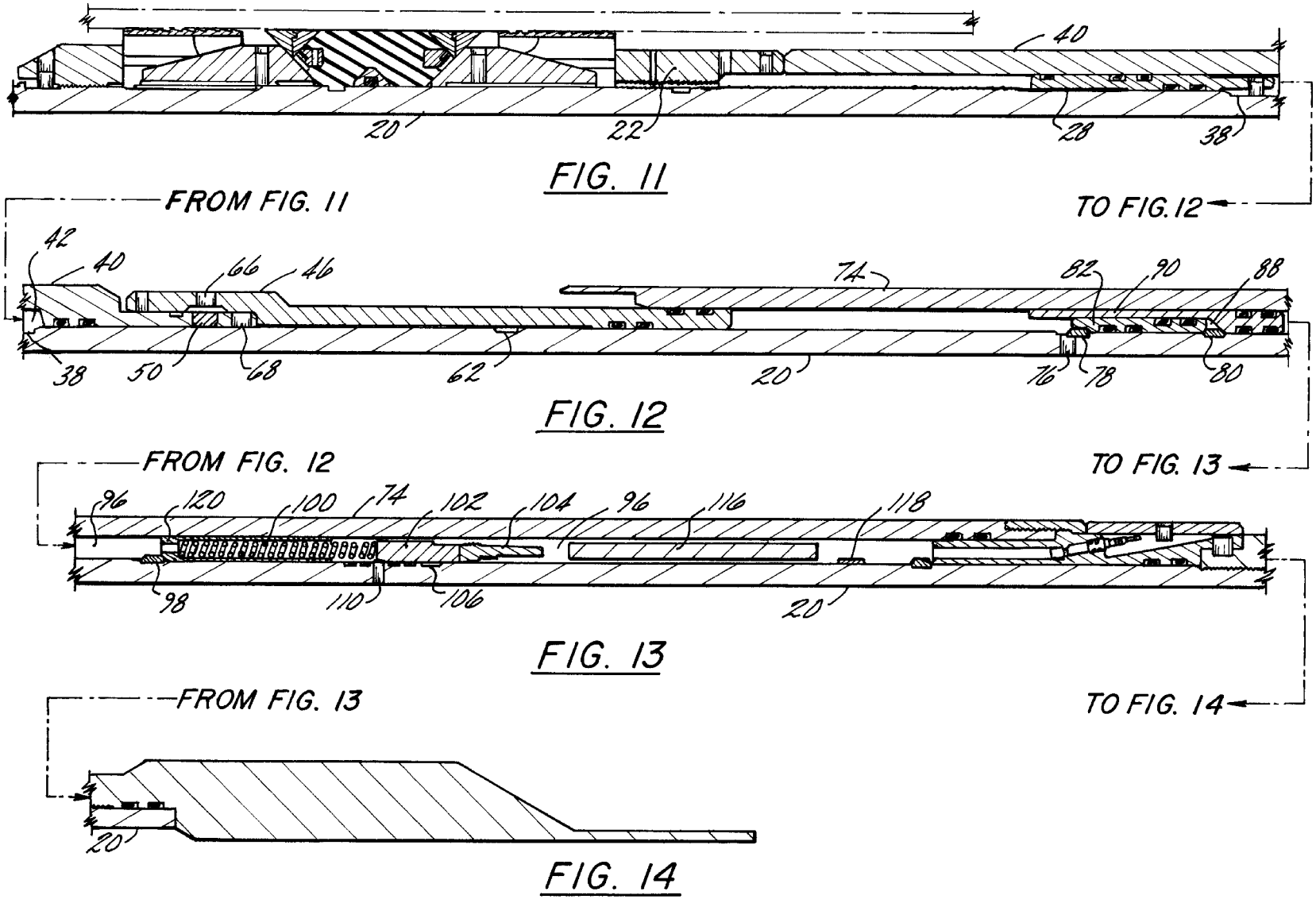
FIGS. 11–14 are the embodiment of FIGS. 1–4 and FIGS. 7–10 in the fully deployed condition.
Figures 15, 16, 17, 18:
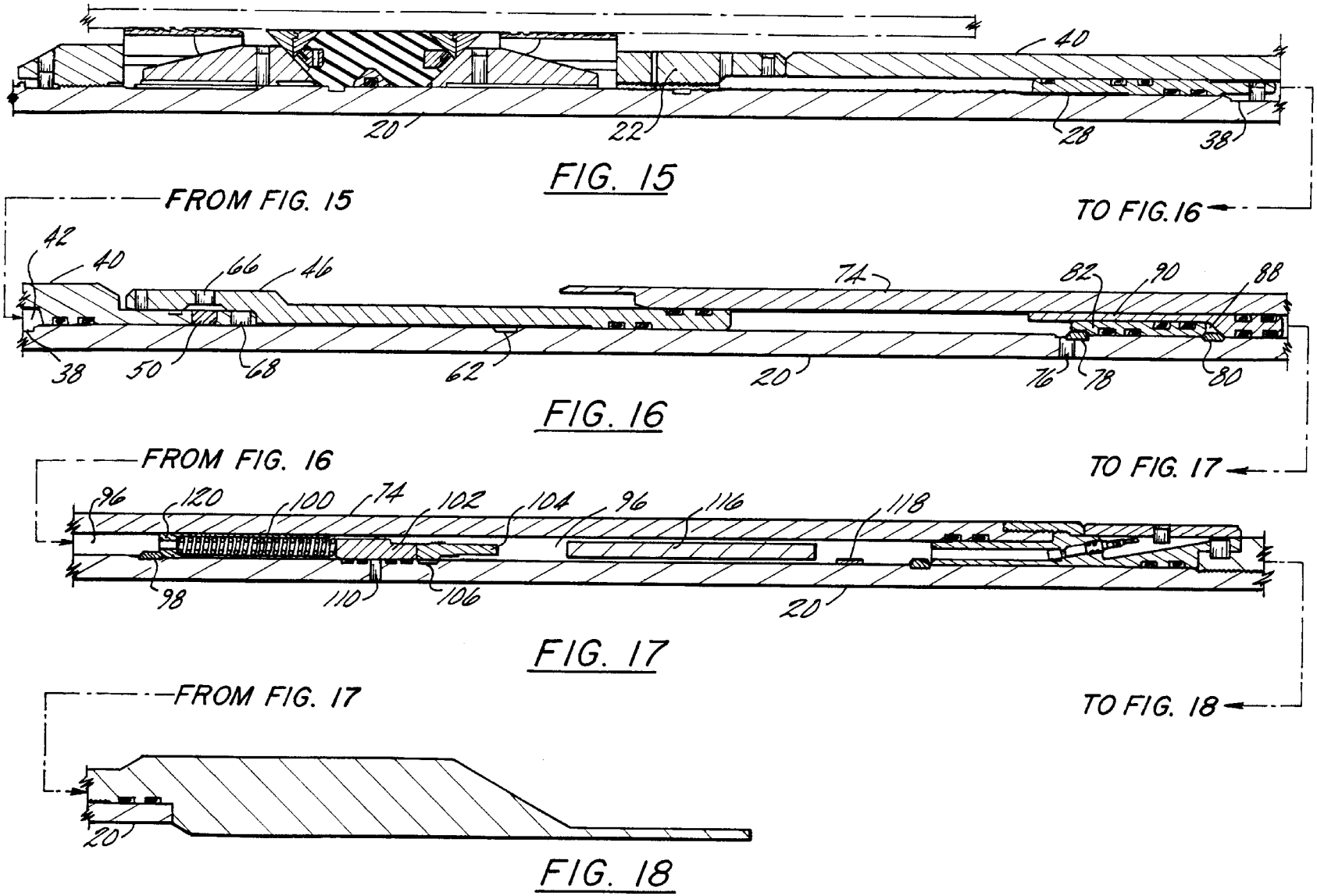
FIGS. 15–18 are a view of the invention in the deployed condition after an electronic failure and hydraulic deployment.

Feed through housing 306 is disposed downhole of atmospheric chamber 304 and is threadably connected to piston housing 266. Feed through housing is machined separately from piston housing 266 for ease and cost efficiency. Through bore 308 also provides access for electrical diagnostic member 310 (see FIG. 31). A split ring 312 prevents movement of the feed through housing relative to the mandrel in one direction while allowing movement in the other direction which is relevant to the retrievability function.

Referring to FIG. 22, the downhole part of feed through housing 306 provides a larger annulus between itself and mandrel 210 within which is disposed secondary piston body 312. Piston 312 includes piston nose 314 which extends from piston body 312 in the uphole direction and provides approximately 1.5 square inches of surface area upon which pressure may bear. Nose 314 is sealed against mandrel 210 and feed through housing 306 with o-rings 316. Port 318 communicates with space 320 and applies hydrostatic force thereon. This area is sealed by o-rings 322 on secondary piston body 312. The piston is held in place by a shear screw 324 extending through feed through housing 306 and by equal hydrostatic force from fluid through port 323. Because the forces on both ends of the piston are generally equal, the piston does not move. Piston 312 also includes threads 328 on the OD thereof which communicate with retainer ring 330 on collet housing 332. Ring 330 engages threads 328 in the event a hydraulic contingency set is necessary or when the tool is retrieved the ring prevents oscillatory movement of piston 312 thus avoiding unnecessary o-ring wear.

Collet housing 332 extends downhole to provide support for collet 334 and to lock collet finger ends 338 in place. Finger ends 338 are also supported by collet support 342 which is connected to finger ends 338 with shear screw 340. The collet housing 332 is connected in conventional manner to a bottom sub, known to the art.

Referring back to collet finger ends 338, it will be appreciated that the ends provide surface 344 which abuts surface 346 on collet housing 332. This surface to surface contact is what prevents the collet which is connected to the mandrel 210 from moving uphole and, therefore, enables the packer to be set. A release of the collet will allow mandrel 210 to move uphole and release the setting force on the packer thus enabling its withdrawal from the hole. Finger ends 338 are maintained in the surface to surface contact position by collet support 342. Movement uphole of support 342 will allow deflection of fingers 336 inwardly and out of engagement with surface 346 which allows mandrel 210 to be moved uphole. In order to prevent unintentional movement of collet support 342, the shear screw 340 provides stability. The screw 340 is, however, easily sheared under the influence of a retrieving tool, standard in the industry and not illustrated.

Actuation of this second embodiment of the invention is primarily by electronic means which functions as did the previous embodiment by sensing events and at a predetermined time lighting a resistor wire to cut the Kevlar wrap 294. Upon cutting of the wrap 294, the dog assembly 292 disengages from the mandrel 210 and allows spring assembly 288 to push spring piston 290 off port 296 thus flooding atmospheric chamber 304 and urging, under hydrostatic pressure, lower piston 280 uphole. When hook 278 shears screw 282 and moves off dog 274, the dog moves up into undercut 284 and disengages notch 276 thus allowing body lock ring sleeve 242 to be urged uphole by lower piston 280. It should be appreciated that the movement of lower piston 280 uphole is due to the change in opposing pressures thereon.

More particularly, in the run in condition, lower piston 280 experiences atmospheric pressure of approximately 14.7 lbs/in$^2$ both above and below it so that it does not move. The atmospheric pressure is so small, however, relative to the downhole pressures, that it is essentially a vacuum. Thus, when chamber 304 is flooded the pressure of the hydraulic fluid will urge the lower piston 280 into the lower pressure chamber 272. It should further be noted that in order to maintain the position of the piston housing 266, upper piston 268 is exposed on the uphole end to hydrostatic pressure and at the lower end to atmospheric pressure. Thus, upper piston 268 is urged downwardly into chamber 272. However, since shoulder 269 is positioned on the ID of housing 266, piston 268 cannot move into chamber 272 but will merely maintain downward pressure on housing 266.

The upward progression of lower piston 280 continues without moving another element until surface 267 of lower piston 280 contacts surface 265 of body lock ring sleeve 242 and begins to urge the sleeve 242 upward. Sleeve 242 ratchets up body lock ring 244 on the hereinbefore described threads. Sleeve 242 thereby places an upward urging of lower slip ring uphole to set the packer. Initially, the ratcheting movement urges the slip lock ring 232 because of slip lock segment 226. Approximately 1.5 inches later, however, nose 228 releases segment 226 and the lower slip ring 234 is urged upwardly. Adjustment nut 224 ensures that segment 228 does not fall downhole. Because body lock ring 244 can only ratchet in one direction, the invention cannot move to relax the packer and it is reliably set.

Where the hydraulic contingency of the arrangement is necessary a plug (conventional and not illustrated) is run on coil tubing or a wireline to plug the well below port 318 whereafter pressure is applied from the surface. At a point about 2500 psi differential the piston 312 moves downhole pulling nose 314 with it. The piston 312 moves downhole until the threads 328 engage ring 330 to maintain the piston in that position permanently. While piston 312 is moved downhole, fluid is filling the atmospheric chamber 304. This creates the same result as flooding the chamber through port 296. Thus the contingency is effected.

Referring to FIGS. 27–30, retrieval of the tool is illustrated. A conventional retrieval tool (not illustrated) is necessary to begin the retrieval process and move the tool uphole. Such a tool is commercially available from Baker Oil Tools, Houston, Tex. The retrieval tool is run downhole until it can be positioned below collet support 342. An uphole force is then placed on support 342 to shear screw 340 and draw support 342 uphole until it abuts surface 335 of collet 334. Surface 335 provides a strong engagement position upon which the retrieval tool can bear to lift the 1500–2000 lb invention uphole.

The removal of the collet support 342 allows fingers 346 to deflect inwardly which allows finger ends 338 to disengage from surface 346 enabling both the collet 334 and the mandrel 210 to be moved uphole by the retrieval tool. The stroke necessary to dislodge the packer is ascertainable by examining slot 289 in mandrel 210 in which split ring 287 resides in combination with the stroke of lower piston 280. The sum of the movements will equal the distance mandrel 210 will move uphole to dislodge the packer before the retrieval tool will lift the invention out of the borehole. Split ring 287 aids in removing the outer diameter elements of the tool by abutting lower piston 280 which abuts upper piston 268 which abuts adjustment sleeve 254. This relationship can be easily understood from a review of FIGS. 28 and 29. The slip saver ring 220 and slip saver pickup ring 222 are arranged such that as mandrel 210 moves uphole, ring 220 dislodges the packer wedge first. Immediately thereafter, the pickup ring 222 pulls the slip uphole and then the ring 220 pulls the cone uphole. The sequence of events, as one of skill in the art will appreciate after having read this disclosure, is critical to the retrievability of the packer. If the events did not proceed as described, the packer would not elongate and it would be virtually impossible to remove the same; damage would result. Assuming the sequence is employed, however, the packer is elongated and contact with the borehole casing is released. The tool is then ready to be moved up or down in the borehole.

Figure 6:
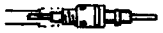
FIG. 6 is an elevation view of the connector for a diagnostic computer.

The diagnostic computer connector illustrated in FIG. 6 is employed for both the permanent and retractable tools, commercially available from Kemlon and commonly referred to as an electrical feedthrough a connector.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A downhole tool with a dual actuation system comprising:

a) a housing including at least one chamber having a lower pressure than ambient downhole pressure;

b) an electronic actuation subsystem capable of flooding said at least one chamber; and c) a hydraulic actuation subsystem capable of flooding said at least one chamber.

2. A downhole tool as claimed in claim 1 wherein said chamber is at atmospheric pressure at a surface level of a well.

3. A downhole tool as claimed in claim 2 wherein said chamber is at 14.7 lbs/in$^2$.

4. A downhole tool as claimed in claim 1 wherein said electronic actuation subsystem further includes a tool actuator.

5. A downhole tool as claimed in claim 4 wherein said electronic actuation subsystem further includes a processor for collecting data received by said sensor and determining when to release power to said tool actuator according to a set of instructions.

6. A downhole tool as claimed in claim 5 wherein said instructions are preprogrammed.

7. A downhole tool as claimed in claim 4 wherein said tool actuator is a piston held in position over a fluid inlet by a dog maintained in engagement with a groove in said mandrel by a retainer, said retainer being releasable in response to a signal from said sensor.

8. A downhole tool as claimed in claim 7 wherein said retainer is a Kevlar cord and said signal releases power from said power source to a resistor which defeats said Kevlar and allows said dog to disengage from said groove allowing said piston to open said inlet.

9. A downhole tool as claimed in claim 7 wherein said retainer is an explosive bolt, said signal exploding said bolt allowing said dog to disengage from said groove allowing said piston to open said inlet.

10. A downhole tool as claimed in claim 7 wherein said piston is moved under bias of at least one spring.

11. A downhole tool as claimed in claim 4 wherein said tool actuator is an explosive bolt positioned at least partially within a fluid inlet, said bolt being operatively connected to said power supply such that said sensor is capable of igniting said bolt at an instructed time.

12. A downhole tool as claimed in claim 7 wherein said actuator is a laser positioned to cut an opening in said mandrel to allow fluid ingress to said at least one chamber.

13. A downhole tool as claimed in claim 7 wherein said actuator is a drill positioned to cut an opening in said mandrel to allow fluid ingress to said at least one chamber.

14. A downhole tool as claimed in claim 7 wherein said actuator is a solenoid positioned to cut an opening in said mandrel to allow fluid ingress to said at least one chamber.

15. A downhole tool as claimed in claim 7 wherein said actuator is a punch tool positioned to cut an opening in said mandrel to allow fluid ingress to said at least one chamber.

16. A downhole tool as claimed in claim 1 wherein said dual actuation system includes at least one sensor adapted to sense at least one predetermined parameter which parameter is related to timing of actuation of the tool.

17. A downhole tool as claimed in claim 1 wherein said sensor is a transducer.

18. A downhole tool as claimed in claim 16 wherein said sensor is connected to a processor having access to and control over a power source.

19. A downhole tool as claimed in claim 18 wherein said power source is a battery.

20. A downhole tool as claimed in claim 1 wherein said system further comprises a release assembly for retrieval of said downhole tool said release assembly including:

a) a collet and collet housing mounted on said downhole tool, said collet having a plurality of releasable fingers normally engaged with said collet housing, to prevent relative movement of the collet and collet housing;

b) at least one slip having bidirectionally angled teeth, supported when engaged by at least one wedge and at least one cone slidingly mounted on said mandrel;

c) at least two rings moveable with said mandrel, said rings being dimensioned to dislodge said wedge primarily, dislodge said slip, secondarily and then draw said cone out of engagement with said slip to collapse said slip enabling retrieval of said tool.

21. A downhole tool as claimed in claim 20 wherein said fingers release by deflecting.

22. A downhole tool as claimed in claim 21 wherein said fingers resist deflection until a predetermined load is placed upon said fingers whereat the fingers deflect and allow relative movement of the collet and collet housing.

23. A downhole tool as claimed in claim 20 wherein said fingers are maintained in the engaged position by a collet support.

24. A downhole tool as claimed in claim 23 wherein said collet support is adapted for engagement with a conventional release tool such that said collet support is removable from its position supporting the fingers thereby allowing the fingers to deflect.

25. A downhole tool as claimed in claim 1 wherein said tool includes at least one piston slidably positioned adjacent said at least one chamber, said piston being moveable upon a rise in hydraulic pressure pursuant to one of (1) electronic actuation and contingent hydraulic actuation.

26. A downhole tool as claimed in claim 1 wherein said hydraulic actuation subsystem includes a predetermined point of entry through said mandrel for influx of surface pressurized downhole fluid.

27. A downhole tool as claimed in claim 26 wherein said predetermined point of entry is a port in said mandrel.

28. A downhole tool as claimed in claim 26 wherein said predetermined point of entry is a punch point for a punch tool.

29. A downhole tool as claimed in claim 1 wherein said dual actuation system includes at least one piston subject to movement relative to said housing upon flooding of said chamber.

30. A downhole tool as claimed in claim 29 wherein said at least one piston is a plurality of interactive pistons which when actuated create a series of movements that deploy the downhole tool.

31. A downhole tool as claimed in claim 1 wherein said hydraulic actuation is a contingency actuation in the event of an electric actuation subsystem failure.

32. A downhole tool with a dual actuation system comprising:

a) a mandrel including at least two chambers having a lower pressure than ambient downhole pressure;

b) at least one piston slideably positioned adjacent said chamber;

c) an electric actuation subsystem including;

1) a power source;

2) a tool actuator;

3) a sensor connected with said power source so as to be capable of releasing power from said power source to said actuator;

d) a contingent hydraulic actuation subsystem including:

1) a predetermined point of entry though said mandrel for influx of surface pressurized downhole fluid.

33. A downhole tool actuation system comprising:

a) an electronic subsystem including:

1) a power source;

2) a gauge electronically connected to said power source;

3) a processor communicatively connected to said gauge; and b) a hydraulic subsystem including at least one hydraulic fluid port located to allow hydraulic actuation of the tool.

34. A retrievable downhole tool and dual actuation system comprising:

a) an electronic subsystem including;

1) a power source;

2) a gauge electronically connected to said power source;

3) a processor communicatively connected to said gauge;

b) a hydraulic subsystem including at least one hydraulic fluid port located to allow hydraulic actuation of the tool; and c) a release mechanism.

35. A retrievable downhole tool having electronic actuation and a hydraulic contingency system comprising:

a) an electronic setting arrangement;

b) a production tube upon which a plurality of pistons are mounted and which pistons define at least one atmospheric chamber;

c) at least one port located in a predetermined position and adapted to allow fluid to move at least one of said plurality of pistons toward said atmospheric chamber.

36. A downhole tool with a dual actuation system comprising:

a) a mandrel including at least one chamber having a lower pressure than ambient downhole pressure;

b) at least one piston slideably positioned adjacent said chamber;

c) an electronic actuation subsystem including:

1) a tool actuator;

2) a sensor informationally connected with said tool actuator;

d) a contingent hydraulic actuation subsystem including:

1) a predetermined point of entry through said mandrel for ingress of surface pressurized downhole fluid.

* * * * *

UNITED STATES PATENT AND TRADEMARK OFFICE

CERTIFICATE OF CORRECTION

PATENT NO. : 5,819,854

DATED : October 13, 1998

INVENTOR(S) : James C. Doane, et al.

It is certified that error appears in the above-identified patent and that said Letters Patent is hereby corrected as shown below:

Column 1, line 57, delete "from" and insert therefor --form--
Column 4, line 27, insert --a-- after "including"
Column 4, line 39, insert a coma --,--after "temperature "
Column 4, line 59, delete "pine" and insert therefor --pin--
Column 6, lines 50 , delete "the"
Column 9, line 13, delete "a"
Column 10, line 23, insert coma --,-- after "tool"
Column 11, line 10, delete "two chambers" and insert therefor --one chamber--

Signed and Sealed this

Twenty-seventh Day of March, 2001

*Attest:*

*Attesting Officer*

Nicholas P. Godici

NICHOLAS P. GODICI

*Acting Director of the United States Patent and Trademark Office*